US010823017B2

(12) United States Patent
Morehead et al.

(10) Patent No.: US 10,823,017 B2
(45) Date of Patent: Nov. 3, 2020

(54) DUAL CAM PHASER

(71) Applicant: ECO Holding 1 GmbH, Marktheidenfeld (DE)

(72) Inventors: James Morehead, Mocksville, NC (US); Daniel Sing, San Francisco, CA (US)

(73) Assignee: ECO Holding 1 GmbH, Marktheidenfeld (DE)

( * ) Notice: Subject to any disclaimer, the term of this patent is extended or adjusted under 35 U.S.C. 154(b) by 0 days.

(21) Appl. No.: 16/706,104

(22) Filed: Dec. 6, 2019

(65) Prior Publication Data

US 2020/0208544 A1 Jul. 2, 2020

Related U.S. Application Data

(60) Provisional application No. 62/779,004, filed on Dec. 13, 2018.

(51) Int. Cl.
*F01L 1/344* (2006.01)

(52) U.S. Cl.
CPC ... *F01L 1/3442* (2013.01); *F01L 2001/34483* (2013.01); *F01L 2001/34489* (2013.01)

(58) Field of Classification Search
CPC ..... F01L 2001/0473; F01L 1/3442; F01L 2001/34483; F01L 2001/34486; F01L 2001/34489; F01L 2001/34496; F01L 1/46
USPC ..... 123/90.15, 90.17, 90.22, 90.23
See application file for complete search history.

(56) References Cited

U.S. PATENT DOCUMENTS

2009/0183702 A1* 7/2009 Knecht ..... F01L 1/053 123/90.15
2010/0050967 A1* 3/2010 Lancefield ..... F01L 1/047 123/90.17
2010/0089350 A1* 4/2010 Myers ..... F01L 1/3442 123/90.17
2010/0175648 A1* 7/2010 Berger ..... F01L 1/34406 123/90.17
2010/0186698 A1* 7/2010 Pluta ..... F01L 13/0036 123/90.17
2013/0032112 A1* 2/2013 Sisson ..... F01L 1/047 123/90.17
2013/0213329 A1* 8/2013 Nakamura ..... F01L 13/0026 123/90.16
2014/0158074 A1* 6/2014 Wigsten ..... F01L 1/352 123/90.15
2018/0171833 A1* 6/2018 Bayrakdar ..... F01L 1/047
2019/0226365 A1* 7/2019 Smerczak ..... F01L 1/3442
2019/0242277 A1* 8/2019 McCloy ..... F01L 1/352
2020/0149439 A1* 5/2020 Brown ..... F16H 53/04
2020/0165943 A1* 5/2020 Keefover ..... F01L 1/3442

* cited by examiner

*Primary Examiner* — Jorge L Leon, Jr.
(74) *Attorney, Agent, or Firm* — Von Rohrscheidt Patents

(57) ABSTRACT

A dual cam phaser for an internal combustion engine, the dual cam phaser including a stator which is drivable by a crankshaft; a rotor which rotatable relative to the stator; a first camshaft; a second camshaft; and a mechanical switching element which is connected to the first camshaft and the second camshaft, wherein the first camshaft and the second camshaft are arranged coaxial with one another, wherein the first camshaft or the second camshaft is connected with the rotor to rotate together with the rotor, and wherein a phase difference between the first camshaft and the second is adjustable by the mechanical switching element.

6 Claims, 2 Drawing Sheets

DUAL CAM PHASER

RELATED APPLICATIONS

This application is a non provisional of U.S. provisional patent application 62/779,004 filed on Dec. 13, 2018 which is incorporated in its entirety by this reference.

FIELD OF THE INVENTION

The invention relates to a dual cam phaser for an internal combustion engine.

BACKGROUND OF THE INVENTION

Cam phasers are used in valve trains of internal combustion engines to enable the phase relation between a crankshaft and a camshaft to be set in an optimum and variable manner. Dual cam phasers are capable of setting the phase relation between the crankshaft and two camshafts.

Dual cam phasers are sufficiently well known in the art. EP 2693003 B1, for example, discloses a phase changing device for a dual-structure camshaft which is rotated by a driving force acting thereon and which comprises an inner shaft and an outer shaft. Here, the phase changing device comprises a phase changing portion, which has a single housing defining an advance hydraulic chamber, a retard hydraulic chamber, and a phase difference hydraulic chamber. The advance hydraulic chamber drives a phase of the dual-structure camshaft by means of a hydraulic pressure as a whole. The retard hydraulic chamber retards the phase of the dual-structure camshaft by means of a hydraulic pressure as a whole. And the phase difference hydraulic chamber changes a difference between a phase of the inner shaft and a phase of the outer shaft by means of a hydraulic pressure. In this case, the advance hydraulic chamber, the retard hydraulic chamber and the phase difference hydraulic chamber are arranged in a circumferential direction of the dual-structure camshaft and define a pair of hydraulic chambers which act on one another. In this arrangement, the phase change portion has a housing as the housing to which a driving force is applied to drive the dual-structure camshaft, a first rotor, which drives the inner shaft, and a second rotor, which drives the outer shaft. Here, the housing is arranged between the first and the second rotor. Moreover, the inner shaft has a flange portion, which is situated between the second rotor and the outer shaft in an axial direction, wherein the phase change portion is situated on the dual-structure camshaft.

As this explanation already illustrates, such cam phasers are of very complex construction and are thus expensive to produce.

BRIEF SUMMARY OF THE INVENTION

It is therefore the object of the invention to improve the construction and operation of a dual cam phaser recited supra and to facilitate the assembly thereof.

The object is achieved by a dual cam phaser for an internal combustion engine, the dual cam phaser including a stator which is drivable by a crankshaft; a rotor which rotatable relative to the stator; a first camshaft; a second camshaft; and a mechanical switching element which is connected to the first camshaft and the second camshaft, wherein the first camshaft and the second camshaft are arranged coaxial with one another, wherein the first camshaft or the second camshaft is connected with the rotor to rotate together with the rotor, and wherein a phase difference between the first camshafts and the second is adjustable by the switching element.

Advantageous embodiments are specified in the dependent claims.

The improved dual cam phaser provides the advantage that it is of only slightly more complex construction than a single cam phaser while offering the full functionality of two cam phasers. In particular, the cam phaser according to the invention is distinguished from the prior art in that only one rotor is required to adjust both camshafts. Thus, only one timing sensor and one controller, e.g. in the form of an oil control valve, or OCV for short, are necessary. This, in turn, has a positive effect in the form of a lower overall mass, a shorter assembly time and ultimately lower material and production cost.

According to an advantageous embodiment, the switching element is designed to be transferable between a first position, in which the first camshaft occupies a first phase position relative to the second camshaft, and a second position, in which the first camshaft occupies a second phase position relative to the second camshaft. Here, the switching element is controlled or actuated by the camshaft connected to the rotor. In addition to the first and the second position, the switching element is advantageously also transferable into additional positions arranged between the first and the second position. With each possible transfer of the switching element into a new position or switching position, the phase position of the first camshaft changes relative to the phase position of the second camshaft. The advantage here consists in particularly simple and efficient setting of the phase difference between the first and the second camshaft.

According to the invention, it is advantageous if the first camshaft is designed as an inlet camshaft and the second camshaft is designed as an outlet camshaft. In this case, the inlet camshaft serves to open and close inlet valves, and the outlet camshaft serves correspondingly to open and close outlet valves on the cylinders of the internal combustion engine. The inlet camshaft is advantageously connected to the rotor and thus forms the active part in the changing of the phase difference between the inlet and the outlet camshaft by means of the switching element. Here too, the advantage consists in particularly simple and efficient setting of the phase difference between the first and the second camshaft. Moreover, in a further embodiment, it is also possible for the second camshaft to be designed as an inlet camshaft and for the first camshaft to be designed as an outlet camshaft. The functions of inlet and outlet camshaft remain the same here in each case.

In a particularly advantageous embodiment, the camshafts are connected in such a way by means of the switching element that they are rotated in opposite directions as the rotor rotates. The setting or changing of the phase difference between the camshafts takes place in a particularly efficient way here since a small rotation of the rotor brings about a direct and trouble-free change in the phase difference.

In alternative embodiments, the camshafts are connected by means of the switching element such that a rotation of the first camshaft in a particular direction may basically lead to a rotation of the second camshaft in the same or the opposite direction. Alternatively, a rotation of the first camshaft in a particular direction may basically lead to a rotation of the second camshaft in the same direction. In the case of a combination of the same and opposite direction of rotation, the guided camshaft is stopped or parked in a mid-position of an admissible range.

According to another advantageous embodiment, the switching element comprises a first adjusting element and a second adjusting element, wherein the two adjusting elements have a common pivot joint, and wherein the first adjusting element is connected to the first camshaft, and the second adjusting element is connected to the second camshaft. In this context, the adjusting elements are elongate bodies, e.g. rods, which are connected at one end to the respective camshaft and at the other end to the common pivot joint. By means of the selected length of the adjusting element and the positioning or arrangement thereof on the camshafts, a desired transfer of a phase adjustment can thus be accomplished.

Building on this, the switching element advantageously comprises a third adjusting element, wherein the three adjusting elements are connected to the common pivot joint, and wherein the third adjusting element is connected to a component arranged in a fixed manner relative to the stator. In this case, the third adjusting element ensures stabilization of the switching element and/or limitation of the possible change in the phase difference between the camshafts. Here, the component is advantageously designed as a housing or a cover of the cam phaser. However, this component can also be a part of the stator which is accessible from the outside.

In another advantageous embodiment, the third adjusting element is connected to the component by means of a stator connection element, which is provided for the purpose of connecting the component itself to the stator. Thus, there is no need for an additional connecting means. This provides an additional saving in terms of weight, costs and production effort.

According to the invention it is furthermore advantageous if the second camshaft is designed in such a way as to be connected to the rotor by means of at least one rotor connection element, and the second adjusting element is designed in such a way as to be connected to the second camshaft, likewise by means of this rotor connection element. Here too, therefore, there is no need for an additional connection element, thus saving weight, costs and production effort.

According to another advantageous embodiment, the switching element comprises a spring element, wherein the spring force of the spring element is opposed to a transfer movement of the switching element between the first position and the second position. In this case, the spring element is retained, on the one hand, on the camshaft connected to the rotor and, on the other hand, on the component arranged in a fixed manner relative to the stator. The spring element is advantageously designed as a spiral spring. Spiral springs are wound in a spiral in one plane and, as a result, are highly curved metal strips. By means of this arrangement, the camshaft connected to the rotor can be returned in a simple and automatic way into its initial position.

The switching element advantageously has a mechanism which connects the camshafts to one another. Here, the mechanism is advantageously arranged and/or designed in such a way that a rotation of the camshaft connected to the rotor results in a rotation of the other camshaft. By means of this arrangement, transfer of a rotary motion between the camshafts can be achieved in a simple manner.

According to the invention, it is advantageous if the camshafts can be rotated in a fixed ratio and in opposite directions relative to one another. This can be achieved, for example, by means of a mechanism which comprises two gearwheels. By virtue of a fixed ratio, phase adjustment of one of the camshafts can be clearly associated with a resulting phase adjustment of the other camshaft. As already mentioned, rotatability in opposite directions is particularly effective since even a small rotation of the rotor or of the camshaft connected to the rotor leads to a direct change in the phase difference between the camshafts.

In a particularly advantageous embodiment, the switching element comprises a stop, which defines a maximum change in the phase difference between the camshafts. Here, the stop is advantageously formed by a stop pin and a stop projection. The stop pin is arranged on the component. The stop projection, on the other hand, is attached to the camshaft which is not connected to the rotor for conjoint rotation therewith. The above-described opposed rotation of the camshafts continues until the stop projection is resting against the stop pin. To be precise, therefore, the stop pin is the stop and the stop projection is the mating part which makes corresponding stop contact. In this state of the switching element, in which the stop projection is resting against the stop pin, the maximum phase difference between the camshafts has been achieved. Further rotation of the camshaft connected to the rotor leads to rotation of both camshafts in the same direction. This further rotation advantageously takes place against the force of the spring element. By means of this arrangement, the variable phase difference can be limited in a simple and effective manner.

In a further embodiment, the dual cam phaser is also usable as a single cam phaser. Here, one of the camshafts, advantageously the outer camshaft, is used as a dummy or idle camshaft or inoperative shaft and is activated by a hydraulic circuit or the rotor. The other camshaft, advantageously the inner camshaft, is correspondingly moved or adjusted by means of the switching element.

BRIEF DESCRIPTION OF THE DRAWINGS

Further advantages of the invention will become apparent from the description and the drawing figure. The invention is described in greater detail based on advantageous embodiments with reference to the drawing figure, wherein.

DETAILED DESCRIPTION OF THE INVENTION

Figure 1:
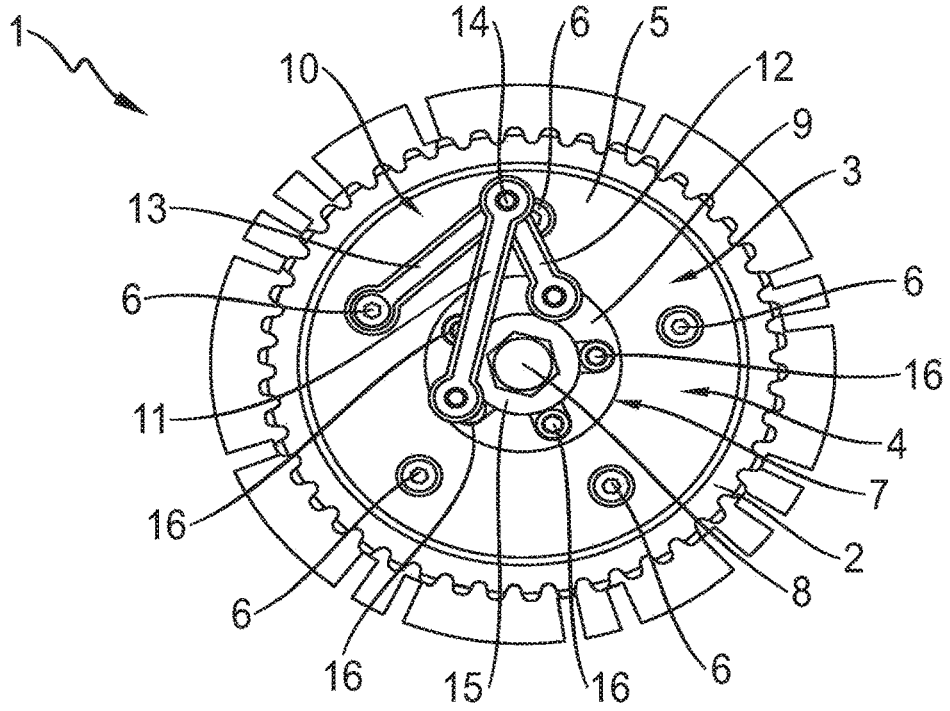
FIG. 1 shows a first embodiment of a dual cam phaser according to the invention in a first state.

FIG. 1 shows a dual cam phaser 1 according to the invention in a first embodiment, said phaser having a toothed ring 2 for mounting a crankshaft (not shown here). The dual cam phaser 1 furthermore comprises a stator 3 (although not visible here), which is connected to the toothed ring 2 for conjoint rotation therewith, and a rotor 4 (although likewise not visible here), which is arranged so as to be rotatable relative to the stator 3. Relative to the stator 3 there is a component 5 arranged in a fixed manner, here in the form of a cover, which covers the stator 3 and the rotor 4. In this first embodiment, the component 5 is secured on the stator 3 by means of a plurality of stator connection elements 6. The component 5 has a central opening 7, through which the ends of two coaxially arranged camshafts 8, 9 project. In this specific case, the first camshaft 8 is arranged in such a way as to be surrounded by the second camshaft 9, and the second camshaft 9 is furthermore connected to the rotor 4 for conjoint rotation therewith. Furthermore, the first camshaft 8 is designed as an inlet camshaft and the second camshaft 9 is designed as an outlet camshaft. The dual cam phaser 1 furthermore comprises a first switching element 10, which is arranged externally on the cam phaser 1.

The switching element 10 has three adjusting elements 11, 12, 13, which are connected pivotably to one another by a common pivot joint 14. In this specific case, the adjusting elements 11, 12, 13 are a first adjusting element 11, a second adjusting element 12 and a third adjusting element 13. In this case, the first adjusting element 11 is arranged so as to be connected pivotably to the first camshaft 8, the second adjusting element 12 is arranged so as to be connected pivotably to the second camshaft 9, and the third adjusting element 13 is arranged so as to be connected pivotably to the component 5. In this specific case, the first adjusting element 11 is connected to the first camshaft 8 by means of a switching connection element 15, and the second adjusting element 12 is connected to the second camshaft 9 by means of a rotor connection element 16. The second camshaft 9 is furthermore connected to the rotor 4 by means of a plurality of these rotor connection elements 16. The third adjusting element 13 is connected to the component 5 by means of one of the stator connection elements 6 already mentioned and is thus also connected functionally to the stator 3.

The dual cam phaser 1 in FIG. 1 is in a possible first state or initial state. From this state, a phase difference between the first camshaft 8 and the second camshaft 9 can be changed by rotating the rotor 4. If the rotor 4 is rotated, the second camshaft 9 connected to the rotor 4 for conjoint rotation therewith is also rotated. In the illustrative embodiment shown here, this is specifically a left-hand rotation or counterclockwise rotation. By means of the first switching element 10 connected to the two camshafts 8, 9, the left-hand rotation of the second camshaft 9 initially results in a right-hand rotation or clockwise rotation of the first camshaft 8. This right-hand rotation continues as far as a state of the cam phaser 1 in which the second adjusting element 12 and thus also the rotor connection element 16 arranged thereon is arranged on a straight line with the common pivot joint 14 and the axis of the camshafts 8, 9. This state is shown by FIG. 2.

Figure 2:
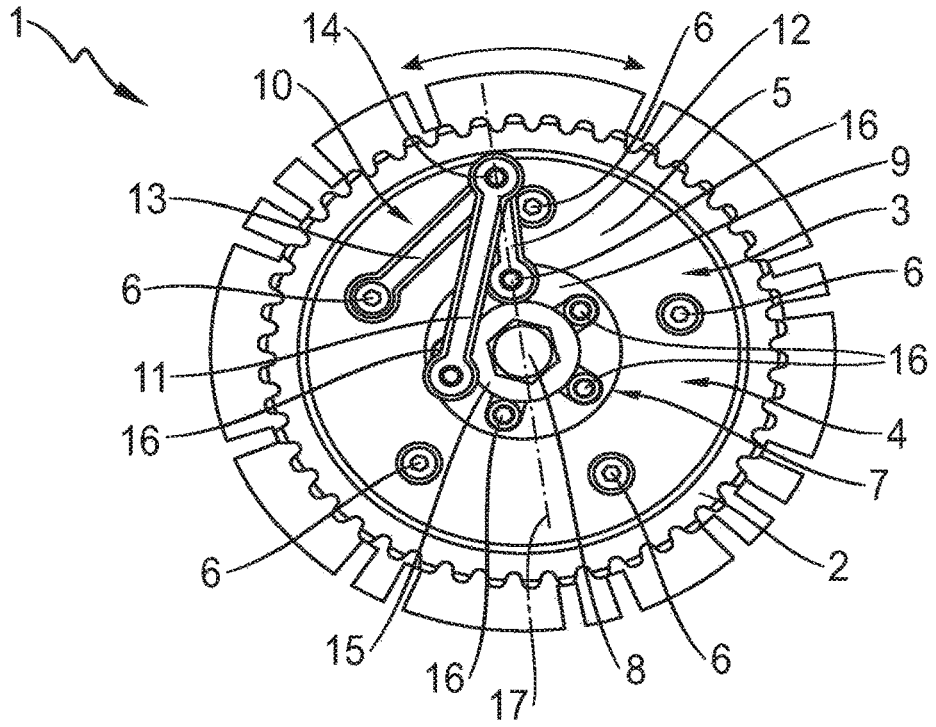
FIG. 2 shows the cam phaser from FIG. 1 in a second state.

In FIG. 2, the dual cam phaser from FIG. 1 is illustrated in a second state. All the components that are visible in FIG. 1 can also be seen here in FIG. 2. As already mentioned, in the second state of the cam phaser 1 which is illustrated here in FIG. 2, the second adjusting element 12 and thus also the rotor connection element 16 arranged thereon is arranged on a straight line 17 with the common pivot joint 14 and the axis of the camshafts 8, 9. Here, the straight line 17 is indicated by means of a dash-dotted line.

Moreover, the first and the second state of the cam phaser define a maximum phase difference that can be set between the camshafts 8, 9. If the left-hand rotation of the rotor 4 which has already been described above, and thus the second camshaft 9, is continued beyond the second state of the cam phaser 1 which is shown here, this then also results in a left-hand rotation of the first camshaft 8 and thus a reduction in the phase difference between the camshafts 8, 9. The simultaneous left-hand rotation of the two camshafts 8, 9 continues as far as a state of the cam phaser 1 in which further left-hand rotation is inhibited by means of the third adjusting element 13. This state is illustrated in FIG. 3.

Figure 3:
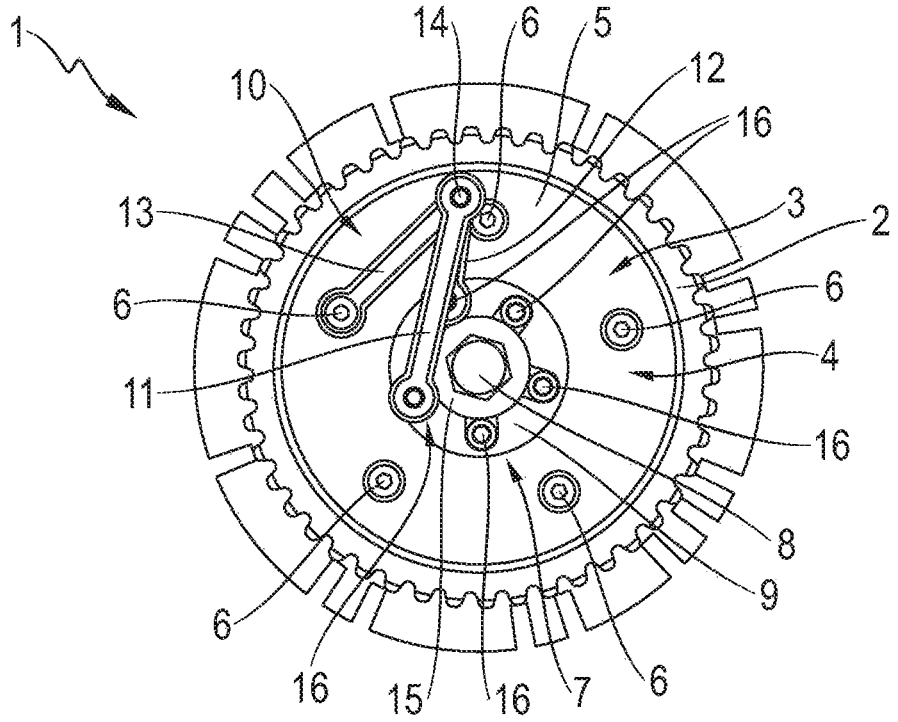
FIG. 3 shows the cam phaser from FIG. 1 in a third state.

FIG. 3 shows the dual cam phaser from FIGS. 1 and 2 in a third state. All the components that are visible in FIGS. 1 and 2 can also be seen here in FIG. 3. As already mentioned, in the third state of the cam phaser 1 which is illustrated here in FIG. 3, further left-hand rotation of the camshafts 8, 9 is inhibited by means of the third adjusting element 13.

If the rotor 4 or the second camshaft 9 is then rotated back again or transferred by means of a right-hand rotation into the initial state of the cam phaser 1, a right-hand rotation of the first camshaft 8 also occurs at first. However, this right-hand rotation of the camshaft 8 continues only as far as the second state illustrated in FIG. 2. A further right-hand rotation of the second camshaft 9 results in a left-hand rotation of the first camshaft 8. The first state or initial state of the cam phaser 1, which is illustrated in FIG. 1, is achieved as soon as further right-hand rotation of the second camshaft 9 is inhibited, but this time by means of the first adjusting element 11.

Figure 4:
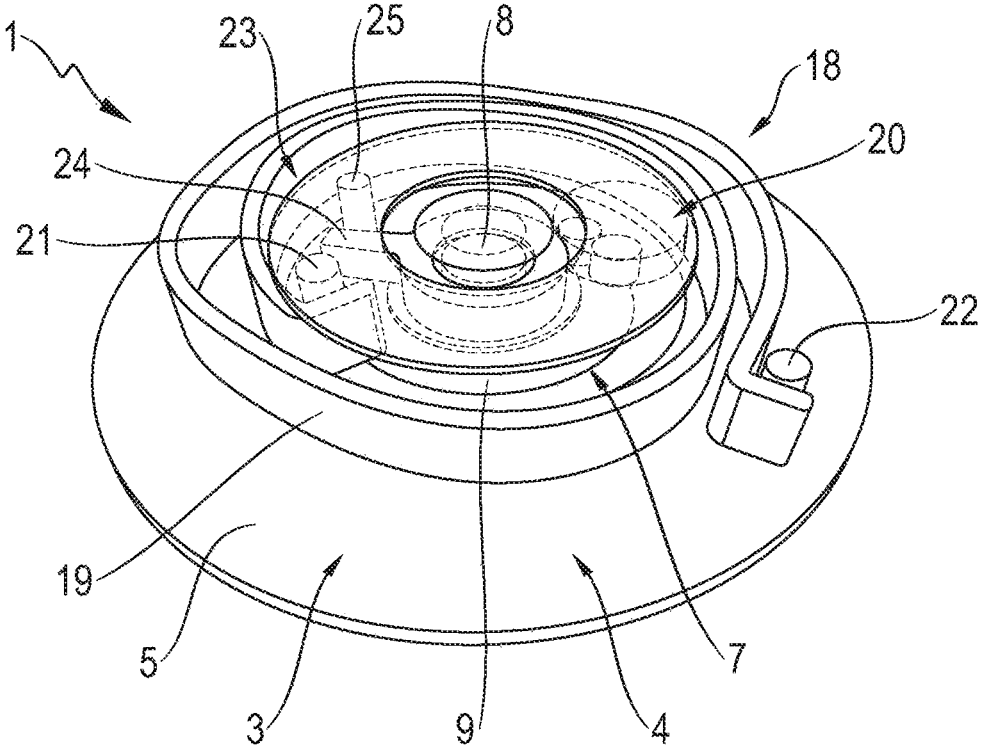
FIG. 4 shows a partial perspective view of a second illustrative embodiment of a dual cam phaser according to the invention.

In FIG. 4, a dual cam phaser 1 according to the invention is illustrated in a second embodiment and in a partial view. In this second embodiment too, the cam phaser 1 comprises the stator 3 (once again not visible here) and the rotor 4 (likewise not visible here) as well as the component 5, which is arranged in a fixed manner relative to the stator 3 and which in this case too is designed as a cover with a central opening 7. Once again, the ends of the coaxially arranged camshafts 8, 9 project through this opening 7, in the same way as in the cam phaser 1 in FIGS. 1 to 3. Here too, the second camshaft 9 is furthermore connected to the rotor 4 for conjoint rotation therewith. However, the camshafts 8, 9 and the component 5 in this second embodiment are connected to one another by means of a second switching element 18.

The second switching element 18 comprises a spring element 19, here in the form of a spiral spring, and a mechanism 20, here in the form of two gearwheels—not visible here. The spring element 19 is retained, on the one hand, by a first retention element 21 on the second camshaft 9 and, on the other hand, by a second retention element 22 on the component 5. The mechanism 20 connects the camshafts 8, 9 functionally in such a way that rotation of the second camshaft 9 connected to the rotor 4 results in an opposite rotation of the first camshaft 8. This changes the phase difference between the camshafts 8, 9.

The second switching element 18 furthermore has a stop 23 having a stop projection 24 and a stop pin 25, wherein the stop projection 24 is attached to the first camshaft 8 and the stop pin 25 is attached to the component 5. The opposed rotation of the camshafts 8, 9 continues until the stop projection 24 is resting against the stop pin 25, whereby the maximum phase difference between the camshafts has been achieved. Further rotation of the second camshaft 9 leads to joint rotation of both camshafts 8, 9 in the same direction and against the force of the spring element.

All the features explained and shown in conjunction with the individual embodiments of the invention can be provided in various combinations in the subject matter according to the invention in order to simultaneously achieve the advantageous effects thereof. The scope of protection of the present invention is given by the claims and is not restricted by the features explained in the description or shown in the figures.

What is claimed is:

1. A dual cam phaser for an internal combustion engine, the dual cam phaser comprising:

a stator configured to be driven by a crankshaft;

a rotor configured to rotate relative to the stator;

a first camshaft;

a second camshaft;

a mechanical switching element connected to the first camshaft and the second camshaft, wherein the first camshaft and the second camshaft are coaxially arranged, wherein the first camshaft or the second camshaft is connected to the rotor so as to rotate together with the rotor, wherein the mechanical switching element is configured to adjust a phase difference between the first camshaft and the second camshaft, wherein the mechanical switching element includes a first adjusting element, a second adjusting element, and a third adjusting element, wherein the first adjusting element, the second adjusting element, and the third adjusting element pivot about a common pivot joint, wherein the first adjusting element is connected to the first camshaft, the second adjusting element is connected to the second camshaft, and the third adjusting element is connected to a connection component that is fixed at the stator; and a stator connection element which connects the connection component to the stator, wherein the third adjusting element is connected to the connection component via the stator connection element.

2. The dual cam phaser according to claim 1, wherein the mechanical switching element is configured to switch between a first switching position, in which the first camshaft is in a first phase position relative to the second camshaft, and a second switching position, in which the first camshaft is in a second phase position relative to the second camshaft.

3. The dual cam phaser according to claim 1, wherein the first camshaft is an inlet camshaft and the second camshaft is an outlet camshaft.

4. The dual cam phaser according to claim 1, wherein the mechanical switching element connects to the first camshaft and the second camshaft such that the first camshaft and the second camshaft rotate in opposite directions relative to each other as the rotor rotates.

5. The dual cam phaser according to claim 1, wherein the connection component is a housing or a cover of the dual cam phaser.

6. The dual cam phaser according to claim 1, wherein the second camshaft is connected to the rotor via a rotor connection element, and wherein the second adjusting element is connected to the second camshaft via the rotor connection element.

* * * * *